US010426305B2

(12) United States Patent
Ebert et al.

(10) Patent No.: US 10,426,305 B2
(45) Date of Patent: Oct. 1, 2019

(54) SUCTION DEVICE

(71) Applicant: Alfred Kärcher GmbH & Co. KG, Winnenden (DE)

(72) Inventors: Florian Ebert, Kernen (DE); Felix Bensing, Stuttgart (DE); Simon Jetter, Oberstenfeld (DE); Gábor Peflof, Winnenden (DE); Dominik Scholl, Waiblingen (DE)

(73) Assignee: Alfred Kärcher SE & Co. KG, Winnenden (DE)

( * ) Notice: Subject to any disclaimer, the term of this patent is extended or adjusted under 35 U.S.C. 154(b) by 245 days.

(21) Appl. No.: 15/646,763

(22) Filed: Jul. 11, 2017

(65) Prior Publication Data

US 2017/0340178 A1 Nov. 30, 2017

Related U.S. Application Data

(63) Continuation of application No. PCT/EP2015/050500, filed on Jan. 13, 2015.

(51) Int. Cl.
*A47L 9/00* (2006.01)
*A47L 9/20* (2006.01)

(52) U.S. Cl.
CPC ..... *A47L 9/0081* (2013.01); *A47L 9/20* (2013.01)

(58) Field of Classification Search
CPC ..... A47L 9/0081; A47L 9/20; A47L 9/00
See application file for complete search history.

(56) References Cited

U.S. PATENT DOCUMENTS

| | | | | |
|---|---|---|---|---|
| 5,700,527 | A | 12/1997 | Fuchs et al. | |
| 6,243,913 | B1 | 6/2001 | Frank et al. | |
| 9,380,919 | B2 | 7/2016 | Hensel et al. | |
| 2008/0086835 | A1* | 4/2008 | Stewen | A47L 9/0072 15/347 |
| 2008/0092498 | A1* | 4/2008 | Stewen | B01D 46/10 55/283 |
| 2009/0193612 | A1* | 8/2009 | Weiss | A47L 9/0081 15/347 |

(Continued)

FOREIGN PATENT DOCUMENTS

| | | |
|---|---|---|
| CN | 100 372 489 | 3/2008 |
| DE | 195 17 197 | 11/1996 |

(Continued)

*Primary Examiner* — Dung Van Nguyen
(74) *Attorney, Agent, or Firm* — Womble Bond Dickinson (US) LLP

(57) ABSTRACT

A suction unit is proposed which comprises a suction apparatus, a dirt collection container, a filter device, wherein the dirt collection container is connected in terms of flow via the filter device to the suction apparatus, and a cleaning device for the filter device, wherein the cleaning device forms a noise source for noise emissions in a frequency range below 2000 Hz, and wherein at least one perforated-plate resonator is associated with the cleaning device, wherein the at least one perforated-plate resonator has a chamber with a chamber space and with a chamber wall and has at least one perforated plate which covers the chamber space, and wherein the at least one perforated plate is connected, actively with respect to sound, to the cleaning device.

22 Claims, 4 Drawing Sheets

(56) References Cited

U.S. PATENT DOCUMENTS

| | | | | |
|---|---|---|---|---|
| 2009/0205158 | A1* | 8/2009 | Eckstein | A47L 9/20 15/347 |
| 2009/0205159 | A1* | 8/2009 | Stewen | A47L 9/20 15/347 |
| 2009/0205491 | A1* | 8/2009 | Eckstein | A47L 9/20 95/68 |
| 2009/0205499 | A1* | 8/2009 | Eckstein | A47L 9/20 95/279 |
| 2013/0312792 | A1* | 11/2013 | Hensel | A47L 9/20 134/18 |
| 2015/0238059 | A1* | 8/2015 | Foell | A47L 9/2868 15/352 |

FOREIGN PATENT DOCUMENTS

| | | |
|---|---|---|
| DE | 10 2010 029 524 | 12/2011 |
| EP | 0 399 433 | 11/1990 |
| EP | 1 120 075 | 8/2001 |
| EP | 1 303 209 | 12/2006 |
| EP | 2 657 932 | 10/2013 |
| EP | 1 785 080 | 1/2014 |
| GB | 2 501 992 | 11/2013 |
| JP | 2007 111308 | 5/2007 |
| JP | 2009-100840 | 5/2009 |

* cited by examiner

SUCTION DEVICE

CROSS-REFERENCE TO RELATED APPLICATIONS

This application is a continuation of International Application Number PCT/EP2015/050500, filed on Jan. 13, 2015, which is incorporated herein by reference in its entirety and for all purposes.

BACKGROUND OF THE INVENTION

The invention relates to a suction unit comprising a suction apparatus, a dirt collection container, a filter device, wherein the dirt collection container is connected in terms of flow via the filter device to the suction apparatus, and a cleaning device for the filter device.

EP 1 785 080 B1 has disclosed a sound damper device for a vacuum cleaner, which sound damper device comprises a multiplicity of elongate tubes.

JP 2009-100840 A has disclosed an electric blower and an electric vacuum cleaner having a corresponding blower, in the case of which a motor is arranged in a sound proof housing. An exhaust-air passage is provided on which sound-absorbing materials are arranged. A sound-absorbing material is arranged on a film or a porous plate.

WO 2012/107103 A1, for example, describes a method for cleaning a filter of a vacuum cleaner, in which method the suction power of a suction apparatus is increased before a transfer of an external-air valve into an open valve position and is later reduced again.

SUMMARY OF THE INVENTION

In accordance with the present invention, a suction unit is provided, in the case of which an effective noise reduction is achieved.

In accordance with an embodiment of the invention, the cleaning device forms a noise source for noise emissions in a frequency range below 2000 Hz, and at least one perforated-plate resonator is associated with the cleaning device, wherein the at least one perforated-plate resonator has a chamber with a chamber space and with a chamber wall and has at least one perforated plate which covers the chamber space, and wherein the at least one perforated plate is connected, actively with respect to sound, to the cleaning device.

A perforated-plate resonator (perforated-plate absorber) has, above the chamber space, a resonator space which is delimited in particular on one side by a perforated plate. By means of a perforated-plate resonator, it is possible for noises in the low frequency range (in particular lower than or equal to 2000 Hz) to be reduced in an effective manner by sound absorption.

In particular, sound absorption at a perforated-plate resonator is realized by means of the friction of an oscillating air column against an opening wall of the perforated plate of the perforated-plate resonator.

In the solution according to the invention, the cleaning device forms a noise source for low-frequency noises with a frequency of 2000 Hz or lower and at least one perforated-plate resonator is associated with the cleaning device, wherein the at least one perforated-plate resonator has a chamber with a chamber space and with a chamber wall and with at least one perforated plate which covers the chamber space, and wherein the at least one perforated plate is connected, actively with respect to sound, to the cleaning device. The chamber may have one or more sub-spaces.

It is thus possible for low-frequency noises of the cleaning device to be damped in an effective manner. In particular, banging noises that occur as a result of the operation of the cleaning device can be damped.

The at least one perforated plate is a plate which is equipped with a multiplicity of openings. Said perforated plate is connected, actively with respect to sound, to the at least one noise source, that is to say sound waves of the noise source propagate in the direction of the perforated plate. At the perforated-plate resonator (perforated-plate absorber), it is then possible for sound absorption to be achieved with an effective noise reduction.

It has been found that for example banging noises in the case of a vacuum cleaner, which are generated by a filter cleaning process using external air, can be damped such that a noise reduction at the maximum level by more than 2.5 dB and in particular by approximately 5 dB or more can be realized.

A perforated-plate resonator is defined in particular by its resonance frequency (center frequency), the geometrical dimensions of the chamber space, the geometrical dimensions of the openings in the perforated plate, and the arrangement of the openings on the perforated plate, in particular in terms of the ratio of the area of an opening on the perforated plate to the overall area of the perforated plate. Through corresponding dimensioning, an effective noise reduction can be generated for a specific noise source, for example one which generates banging noises.

The stated frequency range for the noise emission does not mean that noises are emitted only in said frequency range. Higher-frequency noises may also arise. The at least one perforated-plate resonator serves for damping the low-frequency noises below 2000 Hz. In the case of an exhaust-air cleaning device, the higher-frequency noises are generally negligible in relation to the low-frequency noises.

Here, it is provided that the at least one perforated-plate resonator is, with respect to its geometric dimensions and arrangement and form of openings in the at least one perforated plate, dimensioned with respect to the at least one noise source such that a noise reduction at the maximum level of at least 2.5 dB is realized by means of the at least one perforated-plate resonator.

In particular, the cleaning device comprises an external-air valve device. The external air effects a sudden pressure change which leads to the filter cleaning action. Said sudden pressure change also causes banging noises. By means of the solution according to the invention, an effective noise reduction is achieved with regard to such banging noises. For example, WO 2012/107103 A1 describes a method for cleaning a filter of a vacuum cleaner, in which method the suction power of a suction apparatus is increased before a transfer of an external-air valve into an open valve position and is later reduced again. Reference is expressly made to said document.

By way of example, the at least one noise source generates noises owing to a pressure change, wherein the pressure change is in particular more than 50 mbar, and the pressure change is generated in particular in a time period of shorter than 0.05 seconds. For example, the pressure change occurs in approximately 30 ms. In the case of the cleaning of a filter device of a vacuum cleaner by means of an external-air valve, such a pressure change occurs in the corresponding time period, and low-frequency banging noises (generally with a frequency of considerably below 1000 Hz) are then generated.

In particular, the noise source (the cleaning device) generates banging noises. In particular, an external-air valve device generates such banging noises.

In one embodiment, the at least one perforated-plate resonator is arranged with the at least one perforated plate opposite the cleaning device, wherein in particular, a sound-conducting duct is arranged between the cleaning device and the at least one perforated plate. An effective noise reduction is thereby achieved.

In one exemplary embodiment, the at least one perforated plate is arranged on the chamber wall, and in particular, a (lateral) wall of the chamber wall is supported on the perforated plate. It is thereby possible in particular for a perforated-plate resonator to be formed as a type of box which can be easily positioned on a cleaning unit such as for example a suction means.

It is very particularly advantageous if the at least one perforated plate of the at least one perforated-plate resonator has a first side, which faces toward the chamber space, and a second side, which is situated opposite the first side, wherein a multiplicity of openings is provided in the at least one perforated plate, which openings extend continuously between the first side and the second side. Effective sound absorption can be achieved in this way.

In an exemplary embodiment which is simple from a manufacturing aspect, the first side and/or the second side are of planar form. A corresponding perforated plate can be produced easily.

For the same reason, it is expedient if the first side and the second side are parallel to one another.

In one embodiment, the openings, on the first side, open into the chamber space and, on the second side, face toward the at least one noise source. It is thus possible for sound to penetrate into the chamber space in order to realize effective sound absorption.

In one exemplary embodiment, the openings, on the second side, open into a duct which is connected, actively in terms of sound, to the at least one noise source. As a result of the friction of an oscillating air column on an opening wall, effective sound absorption can take place.

It is expedient if at least one sound-conducting duct which leads from the at least one noise source to the at least one perforated plate is provided. It is then possible for sound to be conducted away from a noise source in order to realize effective absorption. In this way, the at least one perforated-plate resonator can be arranged in optimized fashion on a cleaning unit, and in particular, can also be arranged spaced apart from the at least one noise source.

In one exemplary embodiment, the at least one perforated plate forms an enclosure within which the at least one noise source is arranged. In this way, a "large-scale" noise reduction can be achieved. For example in the case of a propagation of sound from the at least one noise source to all sides, an effective noise reduction can be achieved.

It may then be provided that the chamber wall of the at least one perforated-plate resonator at least partially forms a housing wall of the cleaning unit. This yields a construction of the cleaning unit with a minimized number of parts.

In one exemplary embodiment, the chamber wall has a top wall, which is situated opposite the at least one perforated plate, and has a (lateral) wall which is situated between the top wall and the at least one perforated plate. The (lateral) wall forms side walls laterally surrounding the chamber space.

In an exemplary embodiment which is advantageous from a manufacturing aspect, the at least one perforated plate and the top wall are oriented parallel. A corresponding perforated-plate resonator can also be easily calculated with regard to its sound absorption characteristics.

For the same reason, it is expedient if the chamber space has a (hollow) cuboidal shape.

In an exemplary embodiment which is expedient from a manufacturing aspect, the chamber wall has a first transverse wall, a second transverse wall, a first longitudinal wall, a second longitudinal wall and a top wall, wherein the first transverse wall and the second transverse wall are spaced apart and face one another, the first longitudinal wall and the second longitudinal wall are spaced apart from one another and face one another, the first transverse wall and the first longitudinal wall are oriented transversely with respect to one another, and the top wall is oriented transversely with respect to the first transverse wall, the second transverse wall, the first longitudinal wall and the second longitudinal wall. The corresponding perforated-plate resonator has a box shape. Such a perforated-plate resonator can be easily accommodated on a cleaning unit.

For the same reason, it is expedient if the first transverse wall and the second transverse wall are oriented parallel, and/or the first longitudinal wall and the second longitudinal wall are oriented parallel. It is thus possible to realize a perforated-plate resonator which has a cuboidal chamber space. The absorption characteristics of a perforated-plate resonator can be easily calculated in the case of such a configuration. In this way, in turn, an adaptation to given conditions in a cleaning unit is made easily possible, and in particular, a frequency adaptation is made easily possible.

It is expedient if the chamber wall is produced at least partially from an acoustically hard material. An acoustically hard material is to be understood here to mean a material with a reflectance of at least 94%. An acoustically hard material exhibits low sound absorption. An effective noise reduction is then ensured.

It may be provided that a sound absorption material such as for example mineral fiber wool is arranged in at least part of the chamber space. This yields more effective sound absorption.

In particular, the at least one noise source generates noises which are of low frequency and which have a frequency of 1000 Hz or less. Typically, for example, an external-air valve device for the cleaning of a filter device of a suction means generates banging noises with a frequency below 1000 Hz, for example of approximately 700 Hz.

The following description of preferred embodiments serves, in conjunction with the drawings, to explain the invention in more detail.

DETAILED DESCRIPTION OF THE INVENTION

Figure 1:
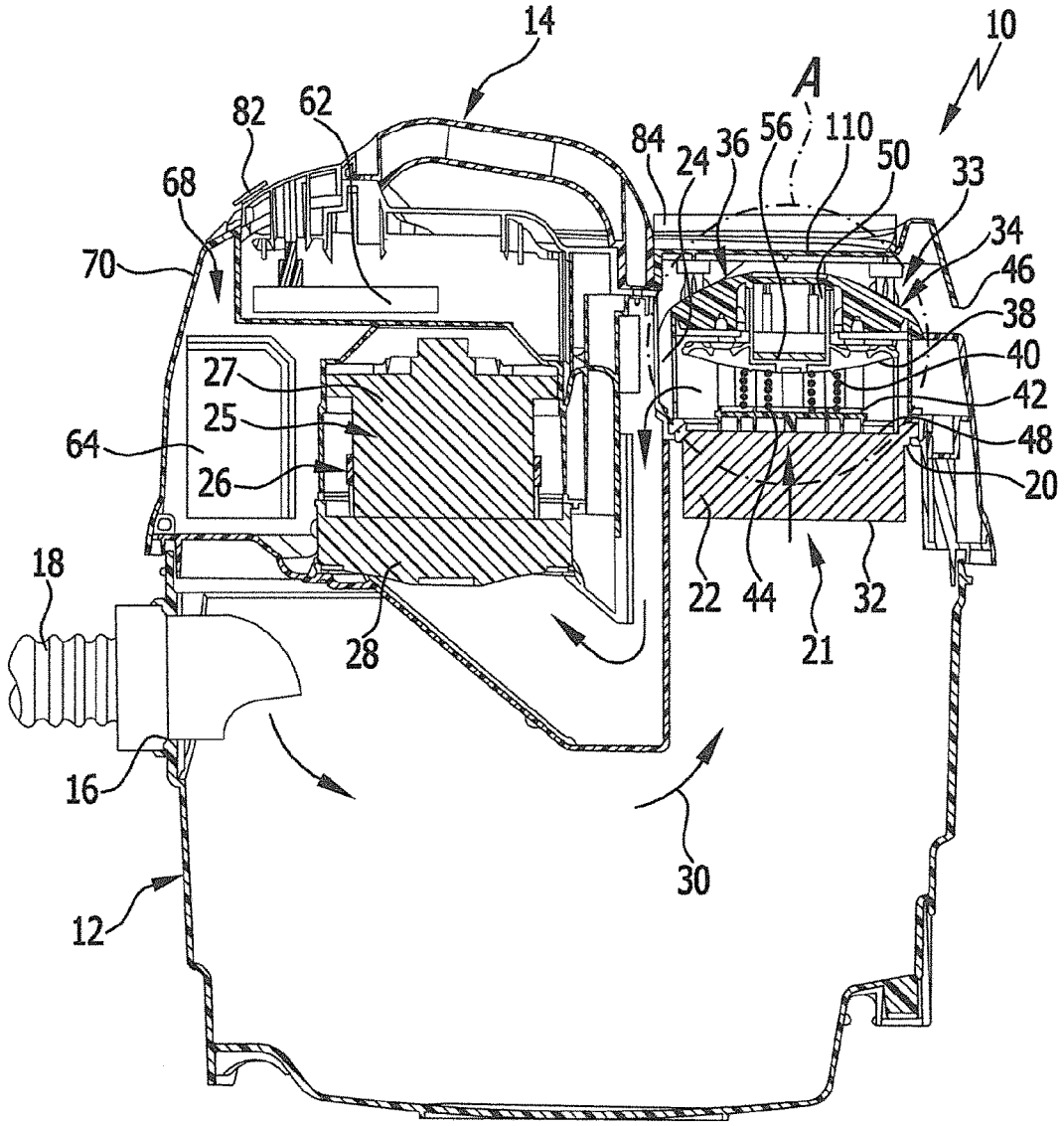
FIG. 1 shows a schematic sectional view of an exemplary embodiment of a suction means (vacuum cleaner) as an example of a cleaning unit.

An exemplary embodiment of a suction means (vacuum cleaner) 10 as an example of a cleaning unit, which is illustrated schematically in FIG. 1 in a sectional view, has a dirt collection container 12 onto which a suction head 14 is mounted. The vacuum cleaner 10 is formed as an example of a vacuum cleaner apparatus and as a stand-alone unit (as an autonomous unit). The dirt collection container 12 has a suction inlet 16 to which, in the conventional manner, a suction hose 18 can be connected. The suction head 14 seals off the dirt collection container 12 at the top side and forms a suction outlet 20 on which a filter device 21 with an (at least one) filter 22 is held. The filter 22 is adjoined by a suction-extraction line 24 by means of which the dirt collection container 12 is connected in terms of flow to a suction apparatus 26. The suction apparatus 26 comprises an electric motor device 25 with an (at least one) electric motor 27 and a blower 28 which is driven in rotation by the electric motor 27.

During operation of the vacuum cleaner 10, the dirt collection container 12 is charged with negative pressure by the suction apparatus 26, such that a suction flow illustrated in FIG. 1 by the arrows 30 is generated. Under the action of the suction flow 30, suction air laden with dirt can be sucked into the dirt collection container 12 via the suction inlet 16, which suction air can then be extracted by suction by the suction apparatus 26. The suction air can be discharged to the surroundings by the suction apparatus 26 via exhaust-air openings 29 (FIG. 7) of the suction head 14.

The suction air flows through the filter 22, such that entrained solids particles are deposited on the dirty side 32, which faces toward the dirt collection container 12, of the filter 22. It is therefore necessary for the filter 22 to be cleaned from time to time, because otherwise it forms an increasing flow resistance, whereby the suction action of the vacuum cleaner 10 is impaired.

Figure 2:
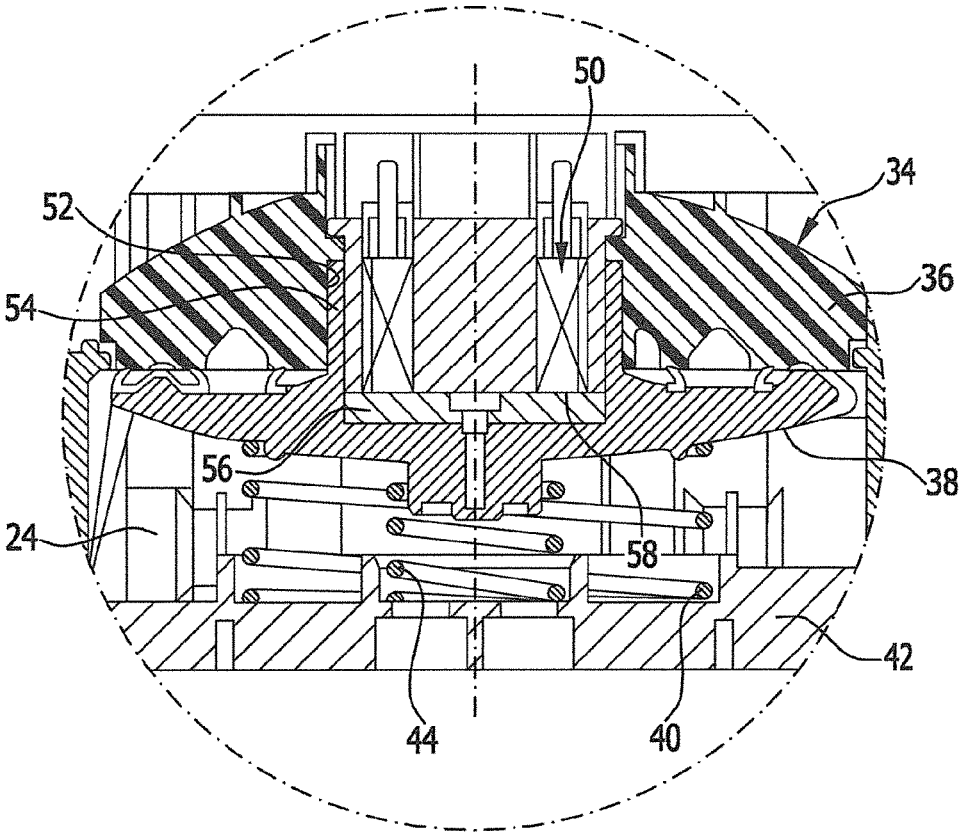
FIG. 2 is an enlarged illustration of an external-air valve device of the suction means as per FIG. 1.

For the cleaning of the filter 22, a cleaning device which is in the form of an external-air valve device 33 and which has an (at least one) external-air valve 34 is arranged above the filter 22 in the suction head 14 (as illustrated on an enlarged scale in FIG. 2). Said external-air valve comprises a valve holder 36 which is arranged positionally fixedly in the suction head 14 and which forms a valve seat for a movable valve body in the form of a valve disk 38. The valve disk 38 is acted on with a closing force in the direction of the valve holder 36 by means of a closing spring 40. The closing spring 40 is restrained between a plate-like filter holder 42, which has a multiplicity of flow passages and which is arranged positionally fixedly in the suction head 14, and the valve disk 38. In addition to the closing spring 40, the filter holder 42 bears a resilient stop element in the form of a stop spring 44. The latter has in particular (preferably in the same way as the closing spring 40) a linear characteristic curve. Said stop spring is for example in the form of a helical spring. By contrast to the closing spring 40, the stop spring 44 is not under preload when the valve disk 38 is in the closed position. Only when the valve disk 38 lifts off from the valve seat of the valve holder 36, the stop spring 44 comes into contact with the underside of the valve disk 38 and is compressed slightly during a further movement of the valve disk 38. Said stop spring thus exerts an increasing restoring force on the valve plate 38 and accelerates the movement of the valve disk 38 proceeding from its closed valve position (illustrated in FIG. 2) via an open valve position back into the closed valve position. In the open valve position, the valve disk 38 assumes a spacing to the valve holder 36 which forms the valve seat.

The valve holder 36 has a multiplicity of passage openings (not illustrated in the drawing), the mouth regions of which are closed by the valve disk 38 when the latter assumes its closed valve position. At the level of the valve holder 36, the suction head 14 has a lateral opening 46. External air can flow into the passage openings of the valve holder 36 via the lateral opening 46. If the valve disk 36 assumes its open valve position spaced apart from the valve holder 36, the lateral opening 46 is connected in terms of flow via the passage openings of the valve holder 36 to the suction-extraction line 24, and external air can impinge on the clean side 48, which is averted from the dirt collection container 12, of the filter 22. If the valve disk 38 assumes its closed valve position, the flow connection between the lateral opening 46 and the suction-extraction line 24 is shut off.

In a central region, the valve holder 36 bears an electromagnet 50. The electromagnet 50 is surrounded in a circumferential direction by a ring-shaped space 52 into which a guide sleeve 54 integrally formed on the top side of the valve disk 38 protrudes. The guide sleeve 54 receives a magnetizable element, for example in the form of an iron plate 56, which in the closed valve position of the valve disk 38 bears against a free face edge 58 of the electromagnet 50 and, in combination with the electromagnet 50, forms a closed magnetic circuit.

The electromagnet 50 is electrically connected via a current supply line to an (electronic) control device 62 arranged in the suction head 14. A supply current is fed by the control device 62 to the electromagnet 50 during normal suction operation of the vacuum cleaner 10. Owing to the magnetic field which forms, the valve disk 38 is reliably held in its closed position. The holding force of the electromagnet 50 is assisted by the spring force of the closing spring 40.

If the current supply to the electromagnet 50 is shut off by the control device 62, the magnetic holding force acting on the valve disk 38 is eliminated, and the valve disk 38 is lifted from the valve seat counter to the action of the closing spring 40 owing to the pressure difference which acts on said valve disk and which results from the external pressure of the external air present in the region of the valve holder 36 and the internal pressure within the suction-extraction line 24. External air can then flow into the suction-extraction line 24 through the passage openings of the valve holder 36 in an abrupt manner, and the filter 22 is impinged on with external air on its clean side 48 in an abrupt manner. This leads to a mechanical vibration of the filter 22. Furthermore, external air flows through the filter 22 in the counterflow direction, that is to say counter to the flow direction 30 that prevails during normal suction operation. This results in effective cleaning of the filter 22.

In one exemplary embodiment, the energy supply to the vacuum cleaner 10 is realized by means of a rechargeable battery device. The latter comprises, for example, two rechargeable batteries.

The battery device comprises for example one or more lithium-ion accumulators. These are arranged, laterally adjacent to the suction apparatus 26, in a battery compartment 68 of the suction head 14. The battery compartment 68 is accessible to the user, for the purposes of exchanging the batteries, by means of an outwardly pivotable flap 70.

The electronic control device 62 is arranged above the suction apparatus 26 in the suction head 14 and is electrically connected to the batteries 64 via supply lines. A pushbutton 82 which can be activated manually by the user is connected to the control device 62 at the input side, which pushbutton is arranged on the top side of the suction head 14. The user can (manually) trigger a filter cleaning process by actuating the pushbutton 82.

The external-air valve device 33 in the suction means 10 is a noise source for banging noises. The sudden ("abrupt")

pressure change which leads to a reversed flow direction through the filter 22 leads to low-frequency banging noises. The relevant frequency range normally lies considerably below 1000 Hz. The pressure drop is abrupt and has a time duration of for example less than 0.05 seconds. The pressure change is in particular 50 mbar (5 kPa) or more.

Figure 3:
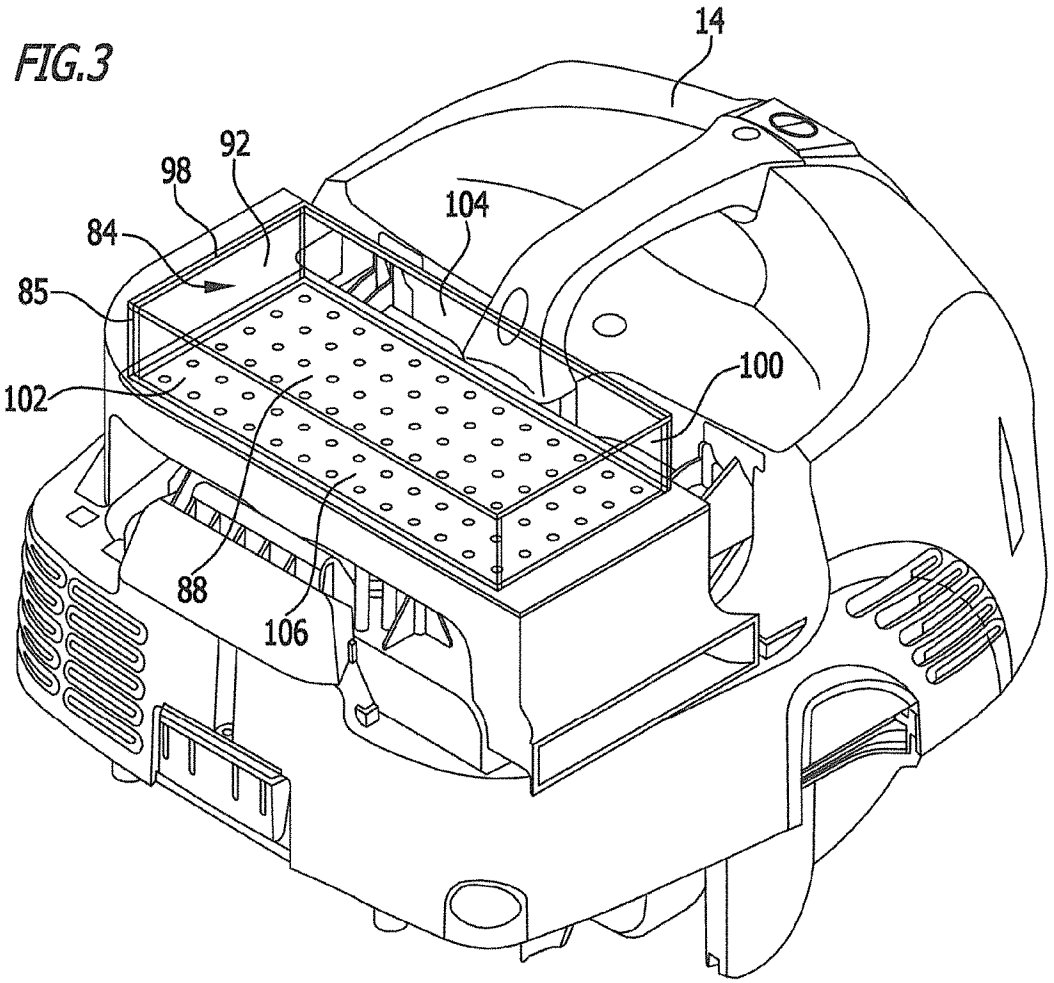
FIG. 3 is a perspective partial view of the suction means as per FIG. 1 with a perforated-plate resonator.
Figure 4:
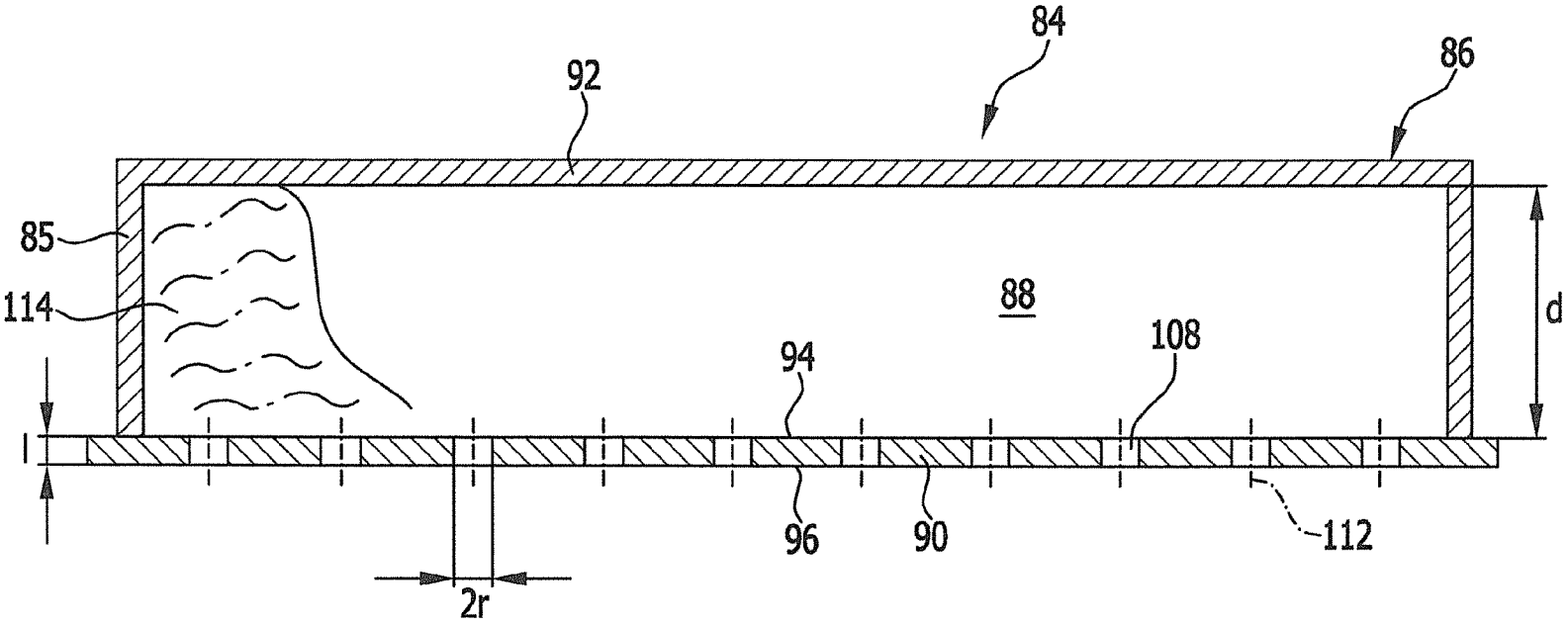
FIG. 4 shows a sectional view of the perforated-plate resonator as per FIG. 3.

For the noise reduction with regard to said noise source, the suction means 10 is equipped with a perforated-plate resonator 84 (FIGS. 1, 3 and 4). The perforated-plate resonator 84 is associated with the external-air valve device 33 as noise source, and said perforated-plate resonator is connected, actively with respect to sound, to said external-air valve device.

The perforated-plate resonator 84 has (FIG. 4) a chamber 85 with a chamber wall 86. Said chamber wall 86 delimits a chamber space 88. The chamber space 88 is closed off by a perforated plate 90.

In one exemplary embodiment (FIG. 4), the perforated plate 90 is supported on the chamber wall 86 and is arranged on the latter. For example, the chamber wall 86 is connected to the perforated plate 90.

In one embodiment, the chamber wall 86 comprises a top wall 92. Said top wall 92 is situated spaced apart from and opposite the perforated plate 90. The chamber space 88 is formed between the top wall 92 and the perforated plate 90.

In one embodiment, the perforated plate 90 and the top wall 92 are situated parallel to one another.

The perforated plate 90 has a first side 94. The first side 94 faces toward the chamber space 88. Said first side furthermore faces toward the top wall 92. The perforated plate 90 furthermore comprises a second side 96. The second side 96 is situated opposite the first side 94. The perforated plate 90 extends between the first side 94 and the second side 96.

The second side 96 of the perforated plate 90 faces, actively with respect to sound, toward the noise source (in the case of the suction means 10, the external-air valve device 33). Sound waves can propagate from said noise source toward the perforated plate 90 and enter the chamber space 88 through openings ("holes") in the perforated plate 90.

In one exemplary embodiment (FIG. 4), the first side 94 and the second side 96 are parallel to one another. The perforated plate 90 is then correspondingly of planar form.

In one exemplary embodiment, the perforated-plate resonator 84 comprises a first transverse wall 98 and a second transverse wall 100. These are spaced apart from one another.

They are for example oriented parallel to one another.

The first transverse wall 98 and the second transverse wall 100 are seated on the top wall 92 and project transversely beyond said top wall.

Furthermore, the perforated-plate resonator 84 comprises a first longitudinal wall 102 and a second longitudinal wall 104. The first longitudinal wall 102 and the second longitudinal wall 104 are spaced apart from one another and face toward one another.

The first longitudinal wall 102 and the second longitudinal wall 104 are for example formed parallel to one another.

The first longitudinal wall 102 and the second longitudinal wall 104 are seated on the top wall 92 and project beyond the latter. The first longitudinal wall 102 and the second longitudinal wall 104 lie transversely with respect to the first transverse wall 98 and the second transverse wall 100. The first transverse wall 98, the second transverse wall 100, the first longitudinal wall 102 and the second longitudinal wall 104 form a (lateral) wall 106 which is seated on the top wall 92 and which laterally closes off the chamber space 98. The perforated plate 90 is in turn arranged on said wall 106 and is supported in particular on end sides of said wall 106.

In one exemplary embodiment, the first transverse wall 98, the second transverse wall 100, the first longitudinal wall 102 and the second longitudinal wall 104 are of straight form. The transverse walls 98, 100 are arranged at right angles to the longitudinal walls 102, 104. The chamber space 88 has in this case a hollow cuboidal shape.

The chamber wall 96 is formed in particular from an acoustically hard material with a reflectance of greater than 94%, which accordingly exhibits a low absorption capacity for sound.

Openings ("holes") 108 are arranged in the perforated plate 90, which openings extend continuously between the first side 94 and the second side 96. At the first side 94, the openings open into the chamber space 88. At the second side 96, the openings 108 open into a duct 110 (FIG. 1) which conducts sound. The duct 110 is arranged between the noise source, that is to say the external-air valve device 33, and the perforated plate 90.

A multiplicity of openings 108 is formed on the perforated plate 90. Said openings are in particular provided in a regular arrangement. Said openings are in particular arranged on grid points of a two-dimensional grid. Elementary cells of said grid are for example squares, rectangles, trapezoids, triangles etc.

In one exemplary embodiment, the openings 108 have a circular cross section. They thus have a (hollow) cylindrical shape.

A direction of extent 112 of an opening 108 is for example oriented parallel to the transverse walls 98, 100 or longitudinal walls 102, 104. The direction of extent 112 is in particular perpendicular to the first side 94 and second side 96 of the perforated plate 90. Said direction of extent is furthermore in particular oriented perpendicular to the top wall 92.

A sound-absorbing material 114 such as mineral fiber wool may be arranged in the whole of, or in part of, the chamber space 88.

The perforated-plate resonator 84 is a perforated-plate absorber which has sound-absorbing characteristics. The sound-absorbing action is improved by means of an acoustically hard form of the chamber wall 86, that is to say by means of correspondingly low sound absorption capacities of the chamber wall 86.

The dimensioning of the perforated-plate resonator 84 with regard to its geometrical dimensions and the arrangement and dimension of the openings 108 determines the effective frequency range for the sound absorption.

In the case of a geometrical construction of the perforated-plate resonator 84 as shown in FIG. 4 with a cuboidal chamber space 88 and transverse walls 98, 100 and longitudinal walls 102, 104 perpendicular to one another, wherein the wall 106 is in turn perpendicular to the perforated plate 90 and to the top wall 92, a center frequency $f_0$ is calculated as $$f_0 = \frac{c}{2\pi}\sqrt{\frac{\varepsilon}{d(l + 2\pi r/4)}} \tag{1}$$

Here, 1 is the thickness of the perforated plate 90 between the first side 94 and the second side 96 plus a mouth correction; d is the height of the chamber space 88 between the first side 94 of the perforated plate 90 and an inner side of the top wall 92; c is the speed of sound. (In this regard, see R. Lerch, G. Sessler, D. Wolf, "Technische Akustik" ["Technical acoustics"], Springer 2009, page 296). The stated formula applies to circular openings 108 with a diameter 2r.

The variable ε is calculated as $$\varepsilon = \text{opening area}/\text{total area} \quad (2)$$

The opening area is in this case the opening area (mouth area) of an opening 108. The total area is the total area of the perforated plate 90 which is exposed to the noise source, that is to say which is impinged on by sound waves.

In the case of the suction means 10, the total area 10 corresponds to that area of the perforated plate 90 which faces toward the duct 110.

In a typical exemplary embodiment, in particular for a suction means with external-air valve device 33, the perforated-plate resonator 84 is configured such that the center frequency $f_0$ is approximately 675 Hz.

For a suction means 10 with external-air valve device, it has been possible to realize a noise reduction of the maximum level by more than 2.5 dB, and for example by approximately 5 dB.

A perforated-plate resonator basically has the following characteristic variables: resonance frequency (center frequency), opening diameter, resonator height (height of the chamber space), thickness of the perforated plate, and hole spacing. For a specific application, said variables are set so as to yield a sufficient noise reduction at the maximum level, for example by more than 2.5 dB, for the relevant frequencies.

A perforated-plate resonator may also be used in conjunction with other cleaning units which comprise noise sources and in particular noise sources that generate banging noises.

LIST OF REFERENCE DESIGNATIONS

10 Vacuum cleaner
12 Dirt collection container
14 Suction head
16 Suction inlet
18 Suction hose
20 Suction outlet
21 Filter device
22 Filter
24 Suction-extraction line
25 Electric motor device
26 Suction apparatus
27 Electric motor
28 Blower
29 Exhaust-air opening
30 Suction flow
32 Dirty side
33 External-air valve device
34 External-air valve
36 Valve holder
38 Valve disc
40 Closing spring
42 Filter holder
44 Stop spring
46 Lateral opening
48 Clean side
50 Electromagnet
52 Ring-shaped space
54 Guide sleeve
56 Iron plate
58 Face edge
62 Control device
64 Battery
68 Battery compartment
70 Flap
82 Pushbutton
84 Perforated-plate resonator
85 Chamber
86 Chamber wall
88 Chamber space
90 Perforated plate
92 Top wall
94 First side
96 Second side
98 First transverse wall
100 Second transverse wall
102 First longitudinal wall
104 Second longitudinal wall
106 Wall
108 Opening
110 Duct
112 Direction of extent
114 Sound-absorbing material

The invention claimed is:

1. A suction unit comprising:
a suction apparatus;
a dirt collection container;
a filter device, wherein the dirt collection container is connected in terms of flow via the filter device to the suction apparatus; and
a cleaning device for the filter device, wherein the cleaning device forms a noise source for noise emissions in a frequency range below 2000 Hz; and
wherein at least one perforated-plate resonator is associated with the cleaning device, wherein the at least one perforated-plate resonator has a chamber with a chamber space and with a chamber wall and has at least one perforated plate which covers the chamber space; and
wherein the at least one perforated plate is connected, actively with respect to sound, to the cleaning device.

2. The suction unit as claimed in claim 1, wherein the at least one perforated-plate resonator is, with respect to geometric dimensions and arrangement and form of openings in the at least one perforated plate, dimensioned with respect to the at least one noise source such that a noise reduction at the maximum level of at least 2.5 dB is realized by means of the at least one perforated-plate resonator.

3. The suction unit as claimed in claim 1, wherein the cleaning device comprises an external-air valve device.

4. The suction unit as claimed in claim 1, wherein the at least one noise source generates noises owing to a pressure change.

5. The suction unit as claimed in claim 4, wherein the noise source generates banging noises.

6. The suction unit as claimed in claim 1, wherein the at least one perforated-plate resonator is arranged with the at least one perforated plate opposite the cleaning device.

7. The suction unit as claimed in claim 1, wherein the at least one perforated plate is arranged on the chamber wall.

8. The suction unit as claimed in claim 1, wherein the at least one perforated plate of the at least one perforated-plate resonator has a first side, which faces toward the chamber space, and a second side, which is situated opposite the first side, wherein a multiplicity of openings is provided in the at least one perforated plate, which openings extend continuously between the first side and the second side.

9. The suction unit as claimed in claim 8, wherein at least one of the first side and the second side is of planar form.

10. The suction unit as claimed in claim 8, wherein the first side and the second side are parallel to one another.

11. The suction unit as claimed in claim 8, wherein the openings, on the first side, open into the chamber space and, on the second side, face toward the at least one noise source.

12. The suction unit as claimed in claim 11, wherein the openings, on the second side, open into a duct which is connected, actively in terms of sound, to the at least one noise source.

13. The suction unit as claimed in claim 1, comprising at least one sound-conducting duct which leads from the at least one noise source to the at least one perforated plate.

14. The suction unit as claimed in claim 1, wherein the at least one perforated plate forms an enclosure within which the at least one noise source is arranged.

15. The suction unit as claimed in claim 14, wherein the chamber wall of the at least one perforated-plate resonator at least partially forms a housing wall of the cleaning unit.

16. The suction unit as claimed in claim 1, wherein the chamber wall has a top wall, which is situated opposite the at least one perforated plate, and has a wall which is situated between the top wall and the at least one perforated plate.

17. The suction unit as claimed in claim 16, wherein the at least one perforated plate and the top wall are oriented parallel.

18. The suction unit as claimed in claim 1, wherein the chamber space has a (hollow) cuboidal shape.

19. The suction unit as claimed in claim 1, wherein the chamber wall has a first transverse wall, a second transverse wall, a first longitudinal wall, a second longitudinal wall and a top wall, wherein the first transverse wall and the second transverse wall are spaced apart and face one another, the first longitudinal wall and the second longitudinal wall are spaced apart from one another and face one another, the first transverse wall and the first longitudinal wall are oriented transversely with respect to one another, and the top wall is oriented transversely with respect to the first transverse wall, the second transverse wall, the first longitudinal wall and the second longitudinal wall.

20. The suction unit as claimed in claim 19, wherein at least one of (i) the first transverse wall and the second transverse wall are oriented parallel, and (ii) the first longitudinal wall and the second longitudinal wall are oriented parallel.

21. The suction unit as claimed in claim 1, wherein the chamber wall is produced at least partially from an acoustically hard material.

22. The suction unit as claimed in claim 1, wherein a sound absorption material is arranged in at least part of the chamber space.

* * * * *